US005187949A

United States Patent [19]

Jung-Il et al.

[11] Patent Number: 5,187,949

[45] Date of Patent: Feb. 23, 1993

[54] AIR CONDITIONER HAVING A SELECTABLE AIR DISCHARGE

[75] Inventors: Seo Jung-Il; Kewon Han-Oh, both of Kyonggi, Rep. of Korea

[73] Assignee: Samsung Electronics Co., Ltd., Suwon, Rep. of Korea

[21] Appl. No.: 736,787

[22] Filed: Jul. 29, 1991

[30] Foreign Application Priority Data

Jul. 28, 1990 [KR] Rep. of Korea ..... 90-11188

[51] Int. Cl.[5] ..... F25D 17/06

[52] U.S. Cl. ..... 62/411; 62/412; 62/324.1; 454/253

[58] Field of Search ..... 62/440, 441, 412, 409, 62/404, 419, 426, 324.6, 324.1, 89; 454/241, 243, 249, 253, 159, 160

[56] References Cited

U.S. PATENT DOCUMENTS

| | | | |
|---|---|---|---|
| 3,008,402 | 11/1961 | Boulet | 454/251 |
| 3,129,753 | 4/1964 | Davis et al. | 62/404 |
| 3,472,146 | 10/1969 | Mazurkiewicz | 62/426 |
| 3,661,069 | 5/1972 | Grosseau | 454/160 |
| 4,090,373 | 5/1978 | Lang et al. | 62/262 |
| 4,182,132 | 1/1980 | Nasser et al. | 62/93 |
| 4,403,644 | 9/1983 | Hebert | 165/1 |
| 4,958,500 | 9/1990 | Kuroda et al. | 62/89 |

*Primary Examiner*—Albert J. Makay
*Assistant Examiner*—William C. Doerrler
*Attorney, Agent, or Firm*—Burns, Doane, Swecker & Mathis

[57] ABSTRACT

An air conditioner includes vertically spaced cooling and heating sections to which air is selectively supplied from a room by means of a blower. The blower is arranged vertically intermediate the cooling and heating sections. A deflector is movable between first and second positions for directing air from the blower toward either the cooling section or the heating section.

8 Claims, 7 Drawing Sheets

FIG. 5(a)
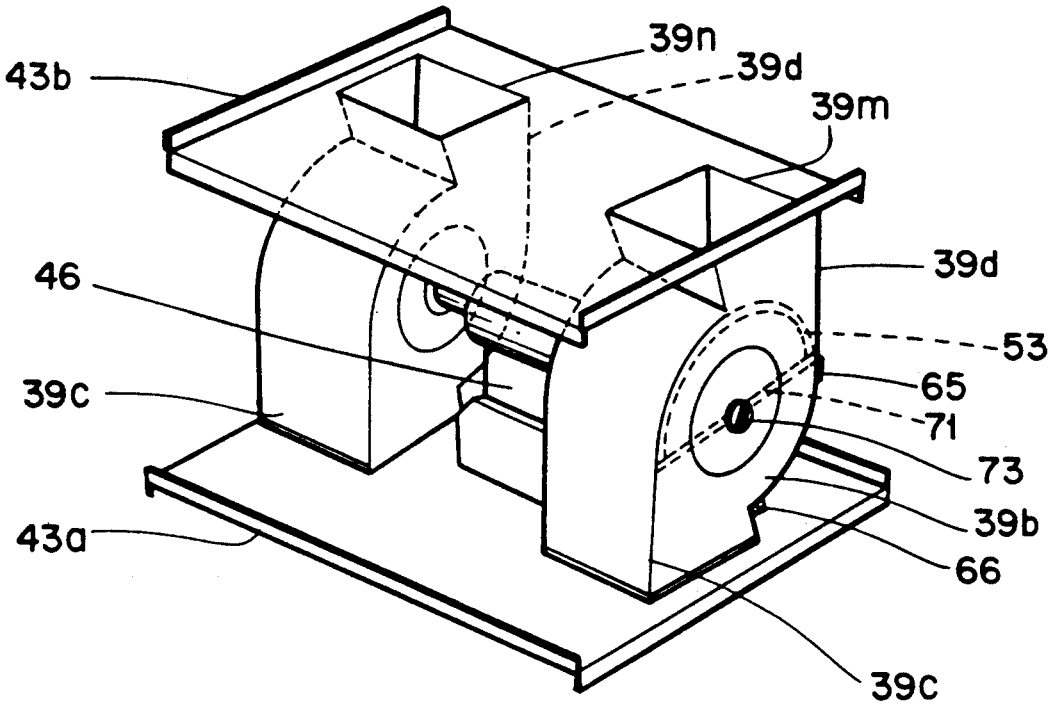
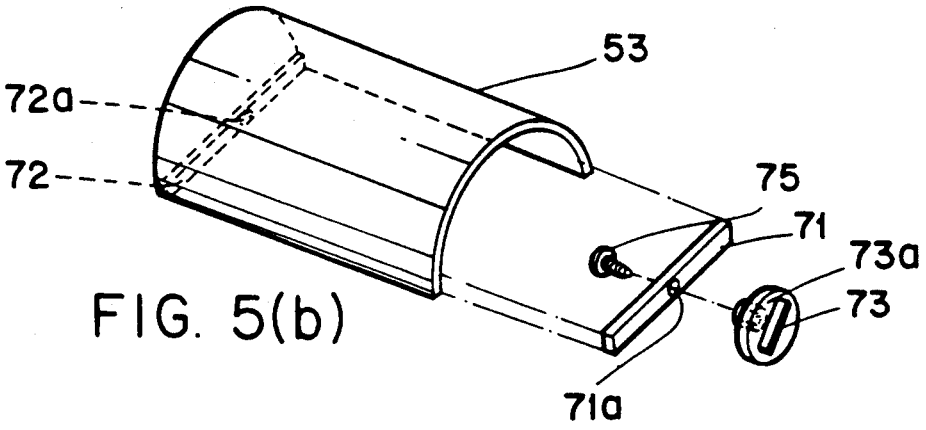
FIG. 5(b)
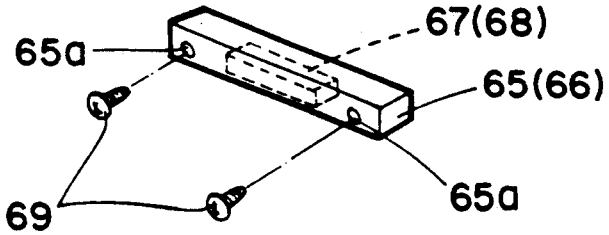
FIG. 5(c)

AIR CONDITIONER HAVING A SELECTABLE AIR DISCHARGE

BACKGROUND OF THE INVENTION

1. Field of the Invention

The present invention relates to an air conditioner, more particularly, to an air conditioner of which the air flow can be freely selected upwardly and downwardly.

2. Description of the Prior Art

A conventional air conditioner is disclosed, for example, in U.S. Pat. No. 3,831,395, which includes a cabinet located in a building space to be conditioned adjacent to a building wall having an opening. The cabinet has a pair of outside air inlets and outlet communicating through the wall opening, and interiorly located condenser in the cabinet situated in a path of cooling air between one inlet and outlet. The cabinet has a room air inlet and a conditioned air outlet, and an evaporator interposed in the path of fluid movement between the room air inlet and conditioned air outlet.

With the air conditioner constructed as described above, the condenser is located in the path of cooling air between the inlet and outlet, the evaporator is interposed in the path of fluid movement between the room air inlet and conditioned air outlet and the conditioned air is discharged through a conditioned air outlet 50 which is formed on the top wall 34, thereby causing a disadvantage that heating efficiency may be deteriorated.

FIGS. 1 and 2 show another conventional air conditioner. As shown in the drawings, a front panel 6 is provided on the front side of an air conditioner body 18 and has at its upper side, a first opening 3 and at its lower side a second opening 4, the first opening having air up/down control plates 1 and the wind right/left control plates 1*a*. In the interior of the second opening 4, a filter (not shown) is preferably disposed in the inner side of a grille so as to filter dust and the like entrained in the room air. An operation control unit 2 for controlling the air conditioner is provided on the upper right area between the first and second openings 3 and 4. Also, a plurality of side fixing plates 5 and 5 are arranged at the lower end of the right and left sides of FIG. 1 (*a*) to fix the air conditioner body to a supporting object not shown in the room. At the generally central area of the right side of FIG. 1, an openable combustor cover 17 is mounted separably so as to allow a user to check a combustion burner 16 which is disposed in the air conditioner (see FIG. 2(*b*)). Furthermore, a cooling heating-exchanger 7 for cooling the room air circulated by a convective blower 11 is arranged on the upper inner side of the front panel 6 as shown in FIGS. 2 (*a*) and (*b*). At the lower side of the heat exchanger 7, a drain pipe 13 is connected to a condensed water collecting bowl to drain outwardly the condensed water, the bowl collecting the condensed water which is produced during due to the cooling of the room air.

Further, a heating heat-exchanger 8 is arranged at the lower side of the heat-exchanger 7 to warm the room air sucked in by the blower 11 so as to warm the room by discharging the warm air through the first opening 3.

More particularly, a connecting opening 15, which accommodates an air supplying pipe for guiding the combustion air to be introduced into the burner, is disposed on the inlet side of the heat-exchanger 8. Therefore, a combustion furnace 9 burns the combustible fuel together with the combustion air introduced through the connecting opening 15 and supplys the generated heat to the heat-exchanger 8. Then, the room air introduced by the blower 11 is discharged through the first opening. Meanwhile, the combustion gas, produced in the combustion furnace 9 during the combustion, is exhausted outwardly through an outlet pipe opening 14 in the heat-exchanger 8.

In the convention air conditioner constructed as described above, the room air necessary for cooling and heating is introduced into the air conditioner through the second opening 4 by the blower 11 attached on the bottom of the air conditioner body 18 and the introduced room air is filtered by means of an intake netting which is not shown. Consequently, the filtered air is heat-exchanged in the heat exchanger 7 or 8 and then the heat exchanged air is discharged through the first opening 3 provided with the up/down control plates 1 and the right/left control plates 1*a*.

In the case of heating, the outside air necessary for combustion is introduced through the connecting opening 15 and burned in the combustion furnace 9 by means of the combustion burner 16. In this case, the waste gas which is produced during the combustion is exhausted through the heat-exchanger 8 and the outlet pipe connecting opening 14.

More particularly, in the heating operation of the air conditioner, cool room air is sucked-in through the second opening 4, arranged on the lower side of the front panel 6, by means of the blower 11 and warmed. The warm air is discharged to the room through the up/down control plates 1 and the right/left control plates 1*a* which are arranged in the first opening 3 formed in the upper side of the front panel 6. Alternatively, in the cooling operation of the air conditioner, the room air is cooled by the high pressure cooling medium, supplied from the compressor of the outside machinery which is not shown, by using the heat exchanger 7 attached on the upper side of the air conditioner body 18, and the heat-exchanger air is discharged to the room through the up/down control plates 1 and the right/left control plates 1*a*, similarly to the heating operation as described above.

In the air conditioner constructed as described above, however, the blower 11 is disposed on the lower side of the air conditioner body 18, and the heating heat-exchanger 8 is disposed at the central area of the air conditioner body 18 and the cooling heat-exchanger 7 is arranged in the upper side of the air conditioner body 18. Thus, in the cooling or heating operation, positive pressure is over-loaded in the interior of the air conditioner body 18 because of the cooling heat-exchanger 7 or heating heat-exchanger 8, whereby heating or cooling efficiency can not be increased. As a result, there is a problem that the amount of air flow for cooling or heating is not obtained sufficiently.

Accordingly, the present invention has been made in consideration of the aforementioned problem and an object of the present invention is to provide an air conditioner in which the output of a blower can be decreased, power consumption also is decreased and positive pressure in the air conditioner body, whereby increasing the cooling and heating efficiency of the air conditioner during the cooling or heating operation.

To achieve the above object, the air conditioner of the present invention having a cooling heat-exchanger and a heating heat-exchanger, comprises; the cooling heat-exchanger arranged on the upper side of an air conditioner body for cooling the room air introduced by a convective blower; the heating heat-exchanger arranged on the lower side of the conditioner body for heating the room air introduced by convective blower; a wind blocking means arranged between the cooling heat-exchanger and the heating heat-exchanger for controlling the flow of the room air introduced by the convective blowers to direct the flowing direction of the room air upwardly or downwardly.

According to the air conditioner of the present invention constructed as mentioned above, the blower is arranged in the central area of the air conditioner body to allow the exchanged air be discharged upwardly or downwardly and the air conditioner body is provided with the heating heat-exchanger at its lower side and the cooling heat-exchanger at its upper side, respectively. Therefore, in the heating operation, the air introduced by the blower is blocked against P area (see to FIG. 3) and directed to Q area by means of the wind blocking means, so that the air is heat-exchanger warmly by passing through the heating heat-exchanger arranged on the lower side of the air conditioner body and then the warmly conditioned air is discharged to the room through an outlet which is disposed on the lower side of the air conditioner body. Alternatively, in the cooling operation, the air introduced by the blower is blocked in a direction of Q area and directed to P area, so that the air is heat-exchanged coldly by passing through the cooling heat-exchanger disposed on the upper side of the air conditioner body and then the coldly exchanged air is discharged to the room through an outlet which is arranged in the upper side of the air conditioner body. Accordingly, in the air conditioner of the present invention, the positive pressure of the air conditioner body is lower than the conventional air conditioner and even if the output capability of the blower used is to be relatively lowed, the proper wind is obtainable. Also, since the present invention applies the principle that the warm air is raised upwardly and the cool air is dropped downwardly, the heating and cooling efficiency can be further improved.

The above and other related objects and features of the invention will be apparent from a reading of the following description of the disclosure found in the accompanying drawings and the novelty thereof pointed out in the appended claims.

BRIEF DESCRIPTION OF THE DRAWINGS

FIG. 1 (*c*) is a side view looking in the direction of the arrow B of FIG. 1 (*a*);

FIG. 2 (*a*) is a partially cutted front view of a front cover in area arranged a cooling heat-exchanger, a heating heat-exchanger and an air inlet shown in FIG. 1 (*a*);

FIG. 2 (*b*) is a side view looking in the direction of the arrow C of FIG. 2 (*a*);

FIG. 3 (*b*) is a view illustrating an inner arrangement FIG. 3 (*a*) in which the front panel is removed therein;

FIG. 3 (*c*) is a side sectional view of FIG. 3 (*a*);

FIG. 5 (*b*) is an exploded perspective view of the wind blocking plate according to the present invention;

FIG. 5 (*c*) is an exploded perspective view of a magnet supporting member arranged on upper and lower sides of a blower case;

FIG. 5 (*d*) is a view explaining operation of the wind blocking plate.

DETAILED DESCRIPTION OF THE PREFERRED EMBODIMENT

A preferred embodiment of the present invention will be now described with reference of the accompanying drawings.

Figure 1A:
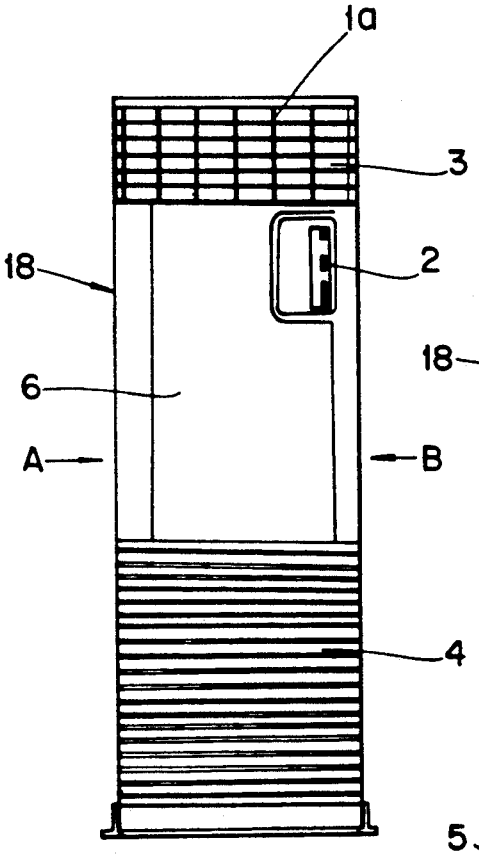
FIG. 1(a) (PRIOR ART)
FIG. 1 (*a*) is an exterior front perspective view of a conventional air conditioner.
Figure 1B:
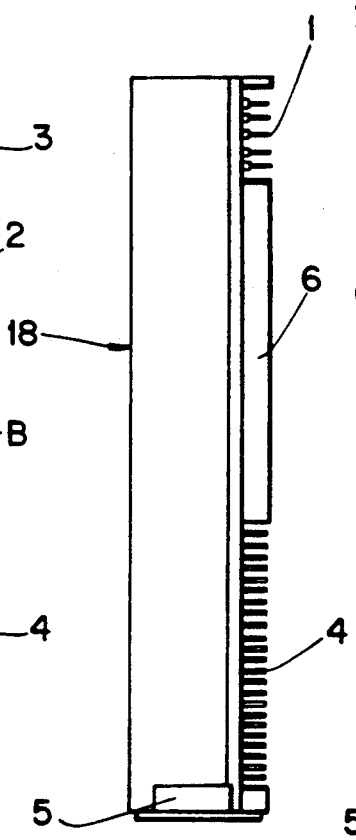
FIG. 1(b) (PRIOR ART)
Figure 1C:
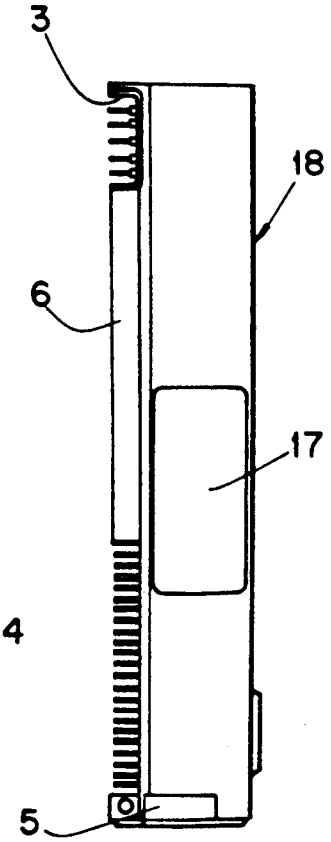
FIG. 1(c) (PRIOR ART)
Figure 2A:
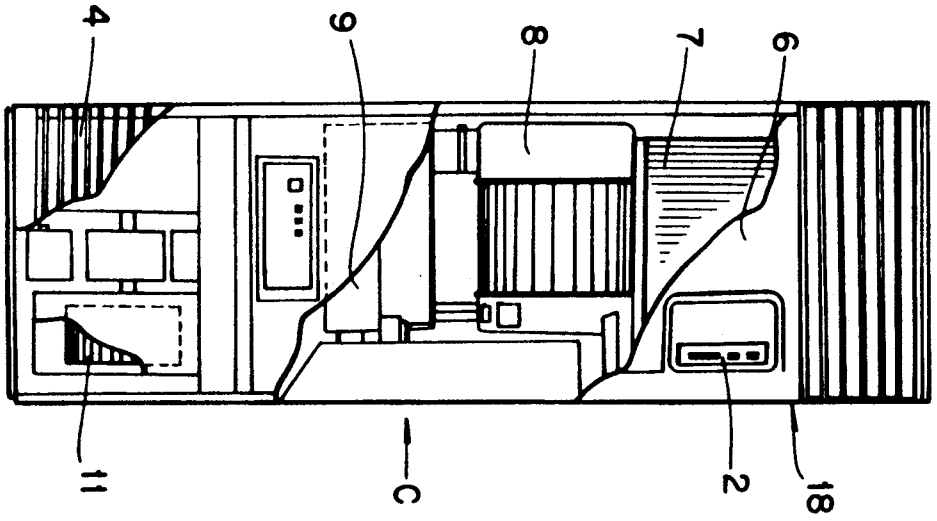
FIG. 2(a) (PRIOR ART)
FIG. 2 (*b*) is a side view looking in the direction of the arrow A of FIG. 1 (*a*)
Figure 2B:
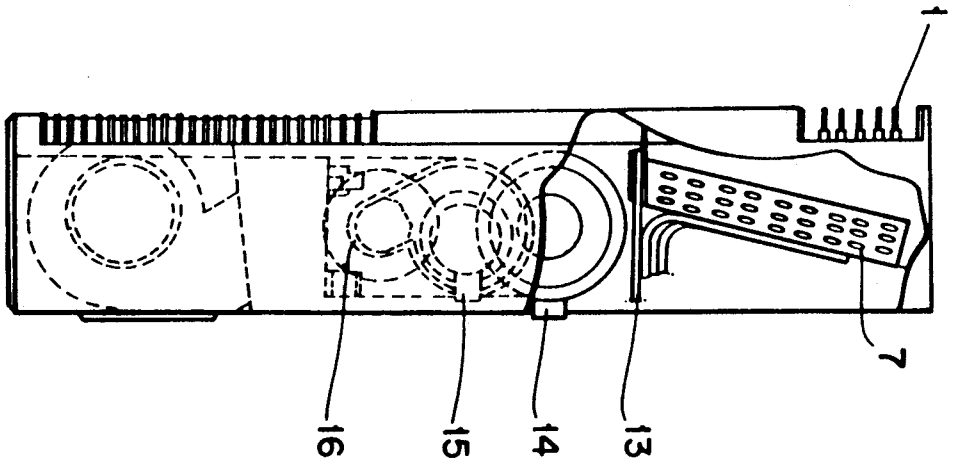
FIG. 2(b) (PRIOR ART)
Figure 3A:
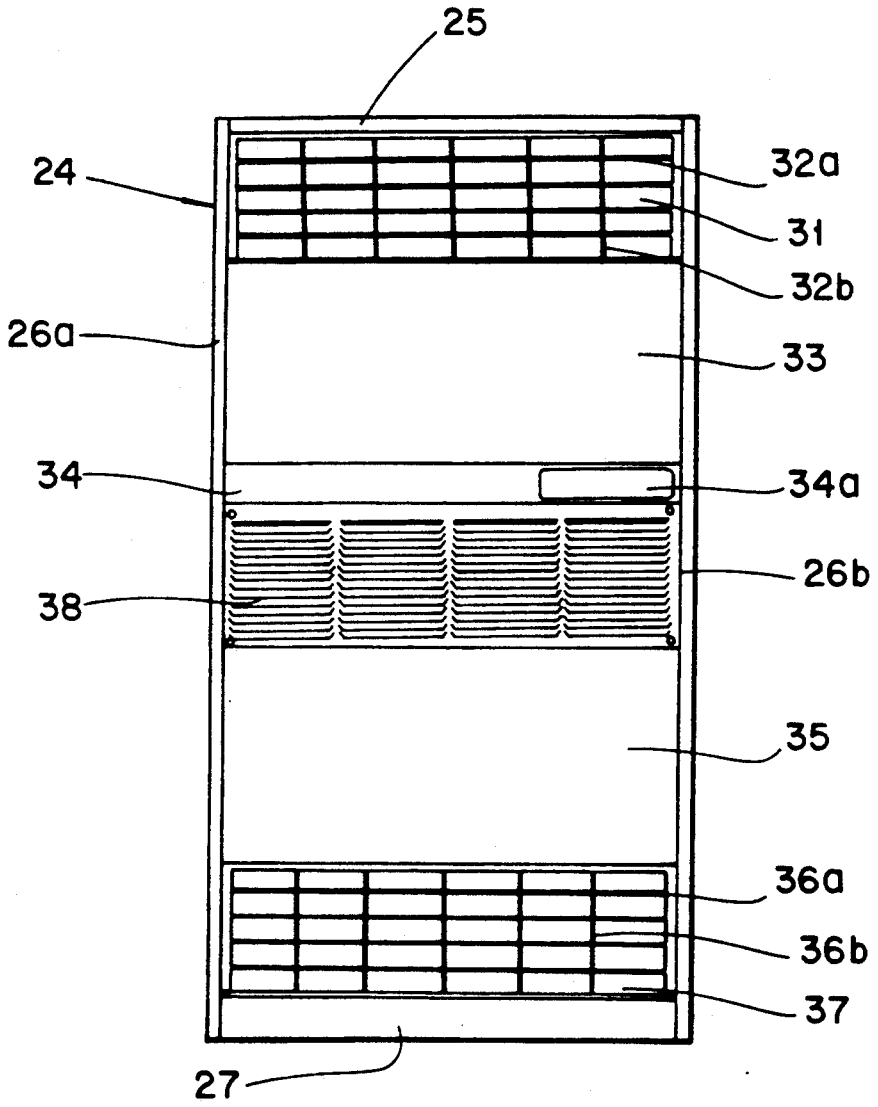
FIG. 3 (*a*) is an exterior front view of a front panel of the air conditioner according to the present invention.
Figure 3B:
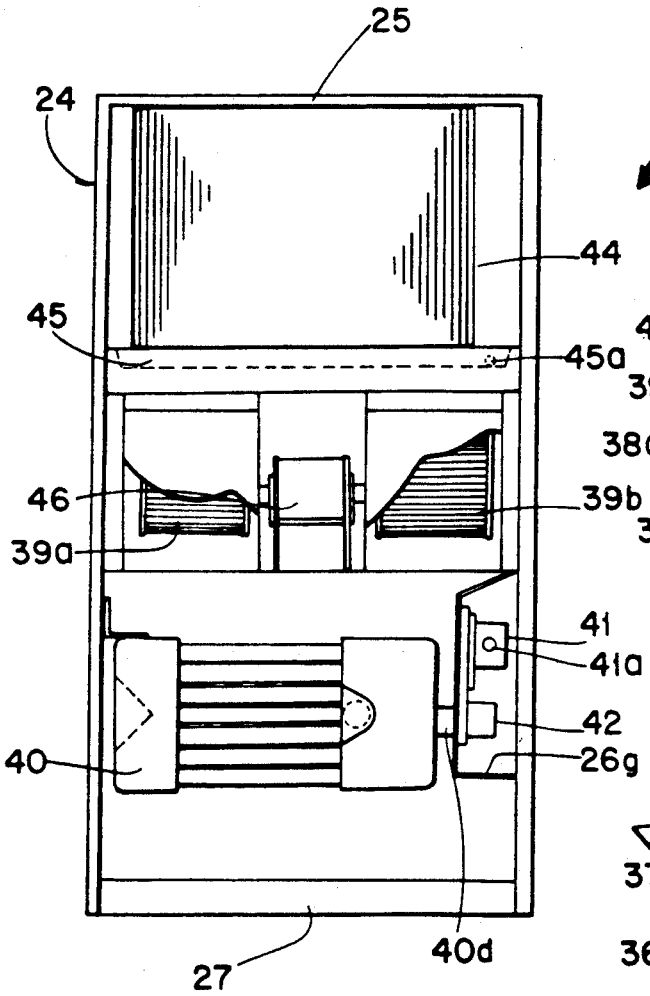
Figure 3C:
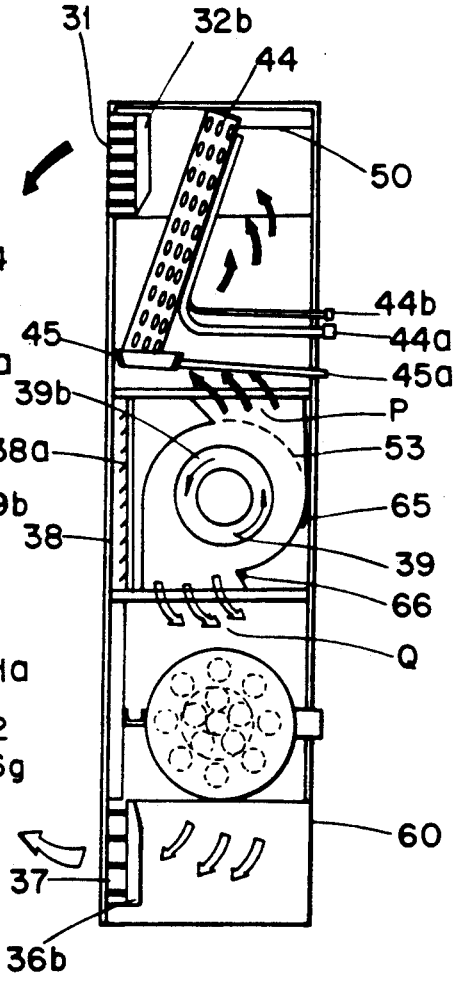
Figure 4:
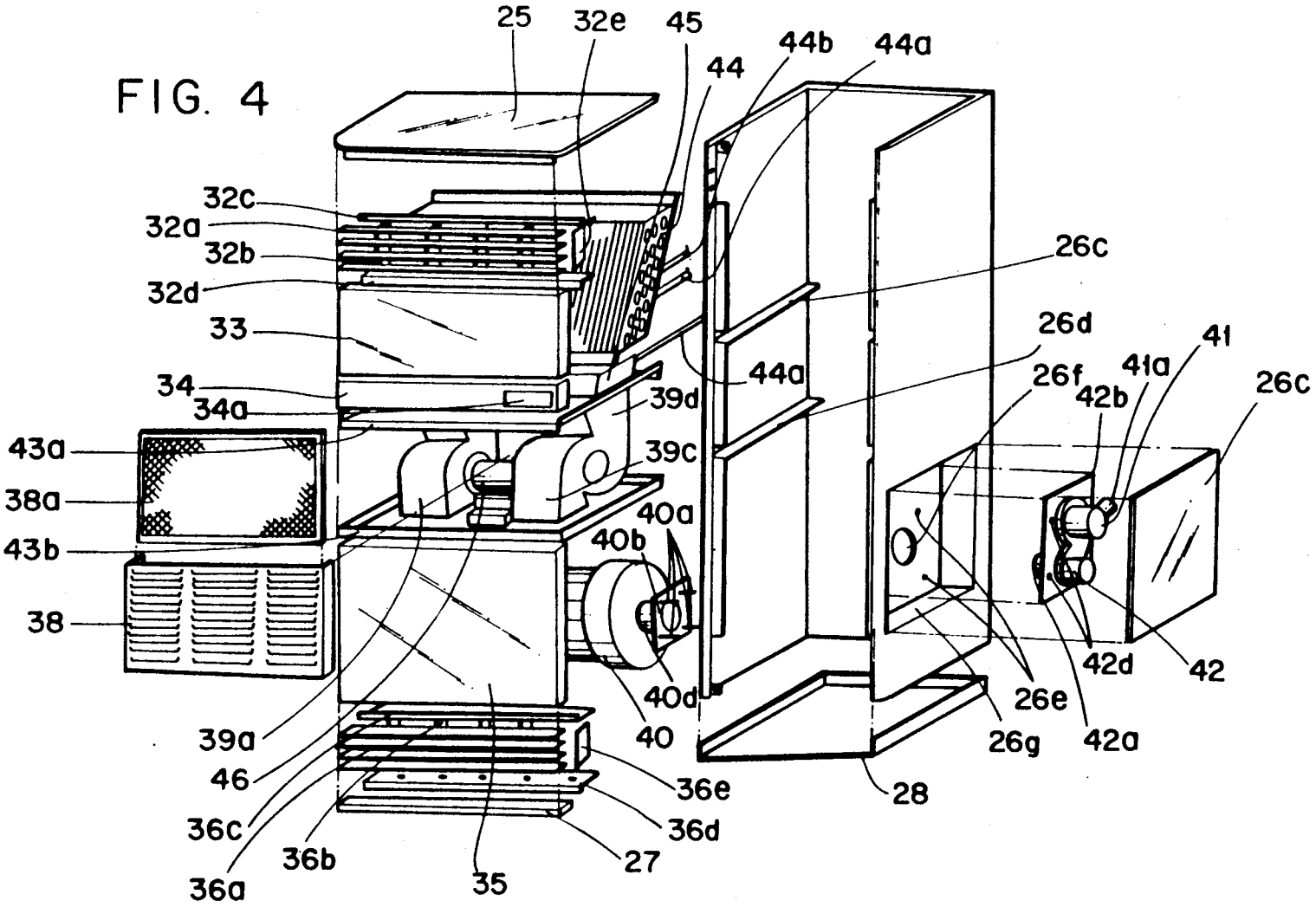
FIG. 4 is a view showing construction of a wind blocking plate according to the air conditioner of the present invention.

Firstly, as shown in FIGS. 3 through 4, the front panel of the air conditioner body 24 which is connected to side panels 26*a* and 26*b*, includes an upper front panel 33 having a plurality of air right/left control plates 32*b* which are supported at its upper and lower ends by upper and lower supporting members 32*c* and 32*d*, and a plurality of air up/down control plates 32*a* which are supported at their right and left ends by right and left supporting members 32*e* (only the right supporting member 32*e* is shown in the drawing). The plates 32*a*, 32*b* extend across an upper outlet 31 for discharging the cool air to the room in a cooling operation. An operation control panel unit 34 is provided with an operation control section 34*a*. An openable air intake panel 38 defines an air inlet for introducing the room air into the air conditioner and has an intake filter netting 38*a* at its inner side. A lower front panel 35 is provided with a plurality of air right/left plates 36*b* supported at their upper and lower ends by upper and lower supporting members 36*c* and 36*d*, and a plurality of air up/down plates 36*a* supported at their right and left ends by right and left supporting members 36*e* (only the right supporting member 36*e* is shown in the drawing). The plates 36*a*, 36*b* extend across a lower outlet 37 for discharging the warm air into the room in a heating operation which will be described later. A bottom supporting plate 27 is provided for covering and supporting the whole surface of a base panel 28 arranged on the bottom of the air conditioner body 24.

The right and left side plates 26*a* and 26*b* of the air conditioner body 24 are integrally formed with the rear panel 60 by a hammering process. A top plate 25 is arranged on the upper side of the air conditioner body 24 and the side plates 26*a* and 26*b* may be formed integrally with the top plate 25 by a bending process. And, in the inner side of each of the right and left side plates 26*a*, and 26*b* a pair of angle-shaped supporting members 26*c* and 26*d* are provided to support upper and lower supporting plates 43*a* and 43*b* which carry blowers 39*a* and 39*b* and a blower motor 46. The plates 43*a*, 43*b* are supported at an elevation between a supported between the heating heat-exchanger 40 and a cooling heat-exchanger 44, that is, at the vertically central area of the air conditioner body 24.

In addition, a generally rectangular division region 26*g* is formed in the right side plate 26*a* of the air conditioner body 24 to support a supporting panel 42*b* which carries an air introducing blower 41 having an end forming the air introducing pipe connecting opening 41*a* and the combustion burner 42. On one side surface of the division region 26*g*, there is provided a through hole 26*f* which is connected with a communicating tube 42*a* of the combustion burner 42 and a communicating tube 40*d* which is formed integrally on one side surface of the heating heat-exchanger 40. Also, on the side surface of the division region 26*g*, four tapped holes 26*e* (only two holes are shown in the drawing) are formed to receive four bolts 40*a*, fixed to a supporting plate 40*b* carried by the communicating tube 40*d* of the heat exchanger 40. Accordingly, the bolts 40*a* are threadingly inserted into four holes 42*d* formed on the supporting panel 42*b* and are coupled to nuts which are not shown. As a result, the communicating tube 42*a* of the burner 42 is connected with the communicating tube 40*d* which is formed on the side of the heat-exchanger 40. The rectangular division region 26*g* is covered with a combustor cover 26*c* and fixed by a nut which is not shown. The cooling heat-exchanger 44 is arranged in a space defined between the upper front panel 33 and a rear panel 60 of the air conditioner body 24, namely, above the blowers 39*a* and 39*b*. The upper end of the heat exchanger 44 is supported by a cooling heat-exchange connecting plate 50, and the lower end thereof is disposed slantingly in a condensed water bowl 45 which is connected to a drain-pipe 45*a*. The cooling medium, compressed by the compressor which is not shown, is injected through an injecting tube 44*b* into the cooling heat-exchanger 44 and returned through an outlet tube 44*a* to the compressor after circulating through the cooling heat-exchanger 44.

Figure 5D:
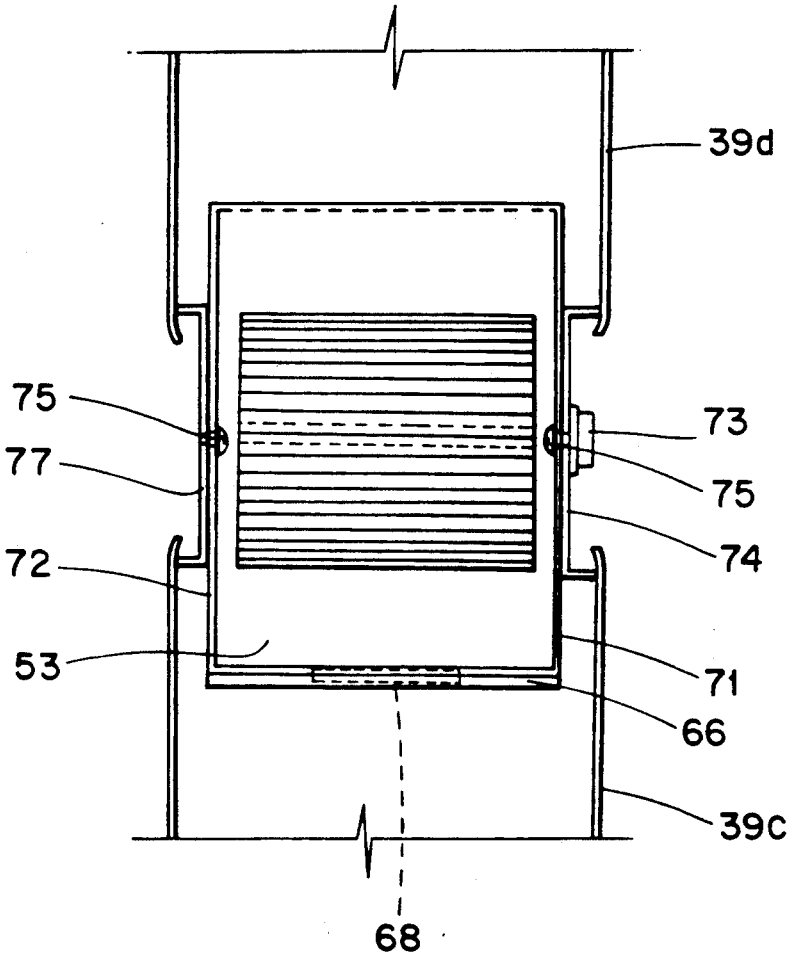
FIG. 5 (*a*) is a view showing an arrangement of the air conditioner according to the present invention in which the wind blocking plate is arranged in the blower.

As shown in FIGS. 5 (*a*) through (*d*), magnets 67, 68 are arranged on the outer side of each blower case. Magnet supporting members 65 and 66, each of which is provided with tapped holes 65*a* and 65*a*, are threadingly fixed to the blower case by means of a fixed screw 69 (see FIG. 5 (*c*)). Also, in the inner side of each blower case, an air blocking plate 53 made of, for example, elastic metallic foil material is supported at its right and left sides by supporting rods 71 and 72. The air blocking plates are arranged rotatable to block the outlets 39*m* and 39*n* arranged in the upper blower cases 39*d* or to block the outlets arranged in the lower blower cases 39*c* (only the outlets 39*m*, 39*n* are shown in FIG. (5*a*)). Magnets 67, 68 act to fix the blocking plate 53 by magnetic force in one of its two positions of adjustment. The supporting rod 71 is threadingly coupled at a tapped hole formed in the center thereof with a tapped hole, not shown, formed in supporting member 74 which is attached at its ends to the upper and lower blower cases 39*d* and 39*c*, and a tapped hole 73*a* formed with a knob 73 by means of a fixed screw 75 and mounted rotatably on the right side of the lower blower case 39*c*. Similarly, the supporting rod 72 is threadingly coupled at a tapped hole 72*a*, formed in its center, with a tapped hole, not shown, formed in a supporting member 77 by means of a fixed screw 75 and mounted rotatably on the left side of the lower blower case 39*c*. Accordingly, when the cooling operation is executed in the air conditioner, an operator or an user opens the intake panel 38 and rotates the knob 73 to thereby move both edges of the wind blocking plate 53 along a a guide rail, not shown, in the blower case, so that the air blocking plate blocks an outlet (not shown) which is formed toward the lower supporting plate 43*a* of the blower 39*b*. Alternatively, when the heating operation is executed in the air conditioner, the operator or an user opens the intake panel 38, rotates the knob 73 is a direction opposite to the cooling operation to block the outlet 39*m* formed toward the upper supporting plate 43*b* of the blower 39*b* by means of the wind blocking plate 53 and then operates normally the air conditioner. Here, while the blower 39*b* positioned on the right side of the body only is described for simplicity of illustration, the left blower 39*a*, of course, is provided with the wind blocking plate which is similar to the plate of the blower 39*b* and acted equally. Also, the magnet supporting members 65 and 66 have the same shaped construction from each other, and the left blower 39*a* is provided with the same magnet supporting members as those of the right blower. Further, as the communicating tubes 40*d* and 42*a* may be used double tube so as to introduce and discharge simultaneously the combustion air to the heating heat-exchanger.

The air conditioner according to the present invention constructed as described above will be now described in reference to the cooling and heating operation.

Firstly, in case of the cooling operation, the operator or an user opens the intake panel 38, rotates the knob 73 to block the outlet, not shown, formed toward the lower supporting plate 43*a* of the blower 39*b* by the wind blocking plate 53 and then closes the intake panel 38. After that, when the operator operates the operation control unit 34*a* to drive the air conditioner, the room air, introduced by blower 39*b* in accordance with the drive of the blower motor 46 is flowed through the outlet 39*m*, formed in the upper supporting plate 43*b* as indicated by a black arrow in the P area shown in FIG. 3 (*c*). As a result, the introduced room air is passed through the cooling heat-exchanger 44 in which the cold agent supplied from the compressor which is not shown is flowed therein, heat-exchanged into the cool air and then the cool air is discharged through the upper outlet 31 to the room to be conditioned.

Meanwhile, in case of the heating operation, the operator or an user opens the intake panel 38, rotates the knob 73 in a direction opposite to the cooling operation to block the outlets 39*m* and 39*n* formed toward the upper supporting plate 43*b* of the blower 39*a* and 39*b* by the wind blocking plate 53 and then closes the intake panel 38. Then, the operator operates the operation control unit 34*a* arranged in the operation control panel 34 to drive the air conditioner, the room air introduced by the blowers 39*a* and 39*b* is flowed through the outlet, formed in the lower supporting member 43*a*, as indicated by the white arrow in the Q area shown in FIG. 3 (*c*) and then the introduced room air is passed through the heating heat-exchanger 40 in which the air heated by the combustion burner 42 located at the lower side of the blower 39*b* is passed through therein. As a result, the introduced room air is heat-exchanged warmly and the warmly conditioned air is discharged to the room.

While the preferred embodiment of the present invention that the knob is arranged in the air conditioner body 24 has been described, the present invention is not limited to that embodiment. For example, a plurality of knobs 73 may be preferably arranged on the right and left side plates 26*a* and 26*b*. With this structure, since the knobs 73 are arranged on the side plates 26*a* and 26*b*, there is an advantage that utility of the air conditioner may be further improved.

As described above, according to the air conditioner of the present invention, since the blower is positioned between the cooling heat-exchanger arranged in the upper side, and the heating heat-exchanger arranged in the lower side, of the air conditioner, namely, in the central area of the air conditioner body, the output of the blower will be lower in case of the cooling or heating operation and the cooling and heating efficiency also may be improved in the cooling and heating operation. Further, power consumption is decreased in accordance with the output decrease of the and positive pressure in the air conditioner body is decreased, thereby it will be appreciated that the present invention is a very practical invention.

What is claimed is:

1. An air conditioner for selectively heating and cooling air circulated therethrough, comprising:

a housing including upper and lower ends, air inlet means located between said upper and lower ends, and air outlet means including an upper outlet located adjacent said upper end, and a lower outlet located adjacent said lower end;

blower means located in said housing adjacent said air inlet means and between said upper and lower air outlets for circulating air into said air inlet means and out of said air outlet means, said blower means including a central portion, an impeller disposed within said central portion, and upper and lower ducts;

a cooling heat-exchanger located between said blower and said upper outlet means for cooling the circulated air, said cooling heat exchanger communicating with said upper duct;

a heating heat-exchanger located between said blower and said lower outlet means for heating the circulated air, said heating heat exchanger communicating with said lower duct; and air directing means comprising a plate movably disposed in said central portion and being adjustable between a first position for directing the circulated air from said blower means upwardly through said cooling heat-exchanger and out of said upper outlet, and a second position of adjustment for directing the circulated air from said blower means downwardly through said heating heat-exchanger and out of said lower outlet.

2. An air conditioner according to claim 1, wherein said plate is curved and rotatable between said first and second positions.

3. An air conditioner according to claim 2 including a manually rotatable knob connected to said plate for rotating the latter.

4. An air conditioner according to claim 1, wherein said plate is formed of a magnetically attractive material, a permanent magnet positioned for releasably holding said plate in each of its first and second positions.

5. An air conditioner according to claim 1, wherein said plate is configured such that when said plate is in its first position, said lower duct is blocked and said upper duct is unblocked, and when said plate is in its second position, said lower duct is unblocked and said upper duct is blocked.

6. An air conditioner according to claim 1, wherein said blower means is disposed substantially midway between said upper and lower outlets.

7. An air conditioner for selectively heating and cooling air circulated therethrough, comprising:

a housing including upper and lower ends, an air located between said upper and lower ends, and inlet air outlet means including an upper outlet located adjacent said upper end, and a lower outlet located adjacent said lower end;

a motor-driven impeller located in said housing adjacent said air inlet and between said upper and lower air outlets for circulating air through said air inlet and out through said air outlet means;

a cooling heat-exchanger located between said impeller and said upper outlet means for cooling the circulated air;

a heating heat-exchanger located between said impeller and said lower outlet means for heating the circulated air; and air directing means adjustably movable between:

a first position for directing all of the air which travels to said impeller from said air inlet upwardly through said cooling heat-exchanger and out of said upper outlet, and a second position for directing all of the air which travels to said impeller from said air inlet downwardly through said heating heat-exchanger and out of said lower outlet, whereby all of the air which said impeller receives from said air inlet is directed to one but not both of said upper and lower outlets.

8. An air conditioner according to claim 7, wherein said impeller is located substantially midway between said upper and lower outlets.

* * * * *